United States Patent [19]

Maruyama et al.

[11] Patent Number: 4,887,955

[45] Date of Patent: Dec. 19, 1989

[54] UNIT INJECTOR

[75] Inventors: Iwao Maruyama; Hidetoshi Saitoh, both of Saitama, Japan

[73] Assignee: Diesel Kiki Co., Ltd., Tokyo, Japan

[21] Appl. No.: 353,408

[22] Filed: May 17, 1989

Related U.S. Application Data

[62] Division of Ser. No. 59,058, Jun. 8, 1987, abandoned.

[30] Foreign Application Priority Data

Jun. 24, 1986 [JP] Japan ..... 61-146031

[51] Int. Cl.[4] ..... F02M 59/46

[52] U.S. Cl. ..... 417/501; 417/570

[58] Field of Search ..... 417/499, 501, 570; 239/88

[56] References Cited

U.S. PATENT DOCUMENTS

| | | | |
|---|---|---|---|
| 2,449,120 | 9/1948 | Johnson | 417/501 X |
| 2,612,841 | 10/1952 | Lasley | 417/501 |
| 2,793,078 | 5/1957 | Brill | 239/88 |
| 4,222,717 | 9/1980 | Clouse et al. | 417/499 |
| 4,365,745 | 12/1982 | Beck | 417/387 |
| 4,530,355 | 7/1985 | Torizuka | 417/490 X |
| 4,541,789 | 9/1985 | Nothdurft | 417/498 |

*Primary Examiner*—Leonard E. Smith

*Attorney, Agent, or Firm*—Henry C. Nields

[57] ABSTRACT

A unit injector for fuel combustion is integrally structured with an injection pumping mechanism and an injection valve mechanism. A housing is fixedly united with an injection pumping part and an injection valve part, the injection pumping part being formed with a stepped insertion hole, and the injection valve part being formed with an oil path extending toward a nozzle body at an end thereof concentrically. A barrel has a hole for guiding a plunger, and fuel inlet and outlet ports, the shape and outer diameter of which are finishing-processed for coinciding with the insertion hole, and the barrel is shrunken in size by cooling and inserted into the insertion hole while it is cooled, and exactly fitted into the insertion hole when the shrinked barrel is recovered to the initial size by returning to the room temperature and supported at an inner diametered part and a stepped part.

4 Claims, 3 Drawing Sheets

UNIT INJECTOR

This application is a division of application Ser. No. 059,058, filed June 8, 1987 now abandoned.

FIELD OF THE INVENTION

The present invention relates to a unit injector, and more particularly to a fuel injection means which is one type of individual fuel injection types integrally composed of an injection pumping mechanism and an injection valve mechanism.

BACKGROUND OF THE INVENTION

In Diesel internal combustion mechanisms, an individual fuel injection means is known as other than concentrated type which is represented by an in-line type and a distributor type. As this type, a unit injector is popular.

In the concentrated type, a pumping mechanism (fuel pressure mechanism) and an injection valve mechanism (injection nozzle) are independent, and on the other hand, the unit injector is characterized in that the injection pumping mechanism and the injection valve mechanism are integrally composed, and they are directly provided to a cylinder head of an engine per each of cylinders.

With respect to the unit injector, in general the injection pumping mechanism and the injection valve mechanism are disposed in series in a housing or a body, but Japanese utility model laid open No. 8827/84 teaches these two mechanisms are disposed transversely each other.

In each of the above embodiments, the injection pumping mechanism is provided with a plunger for receiving transmission of movement from a cam shaft and reciprocating so as to guide sliding of the plunger by means of a barrel, introducing a fuel from an outside of the barrel into a fuel pressing chamber in a range surrounded by a tip of a plunger and the barrel, effecting pressure to the fuel by a lift of the plunger, and sending it under pressure to the injection valve mechanism. Therefore, not only the barrel but also the injection pumping mechanism and the injection valve mechanism must be firmly supported to the housing or body (called as "housing" hereinafter).

Securing structures of the barrel to the housing have been conventionally seen as follows:

(1) The housing is formed with a hole larger than the outer diameter of the barrel, inserting the barrel idly into the housing hole, directly screwing a nozzle holder from an opening of the housing hole, and pressing the barrel in an axial direction toward the bottom of the housing hole with a convex at an end of the nozzle holder.

(2) The housing is formed with a hole larger than the outer diameter of the barrel, inserting the barrel idly into the housing hole, contacting a convex at an end of the nozzle holder to an end face of the barrel, and screwing a bolt into a casing from a bolt hole defined in a flange of the nozzle holder so as to press the barrel in the axial direction.

However, in each of the above structures, the barrel is only supported by the end in the axial direction thereof, and a space is defined between an outer circumference of the barrel and an inner wall of the housing. Therefore, due to the pressure of the fuel acting on a contacting face between the nozzle holder and the end of the barrel, an oil runs out from the contacting face, and the fuel leaks outsides from a meeting between the nozzle holder and the housing, so that the pumping function is decreased and could not satisfy require of the fuel at high pressure.

A measurment therefor is to strengthen screwing of the nozzle holder or strengthen tightening of a bolt. However, the pressure is mainly received in an area of a cylindrical end in the axial direction of the barrel. The inner diameter of the barrel must not be made small in relation with the outer diameter of the plunger which composes a fuel pressing area.

For imparting mechanical strength thereto durable enough against strong pressure in the axial diameter, it is necessary that the outer diameter of the barrel is increased in thickness, so that the outer diameter of the housing is increased accordingly, since it holds the barrel therein. Therefore, the whole body of the housing becomes large in scale and heavy in weight in compay with increasing pressure of the fuel, which affects bad influences to mouting to the engine.

Another one is assumed that the housing per se is directly machined with a barrel. However, in this process, other parts than the barrel will be composed with materials excellent in abrasion resistance or tempering property, taking much time and troubles, and accordingly increasing production cost of the unit injector while decreasing production efficiency.

The present invention has been developed to solve the above mentioned problems through many studies.

It is a primary object of the invention to provide a unit injector which is easy in production, small in scale and may stand to high pressure.

For accomplishing this object, the housing is formed with a stepped hole, into which a barrel having been finishing-processed with an inlet port and an outlet port is fitted by cooling and fixed, so that the barrel is supported in the housing at not only an end portion but also the outer circumference.

In the invention, the housing is provided integrally with an injection pumping part and an injection valve part. The injection valve part is formed with an oil path extending toward a nozzle body secured coaxially therewith, and the injection pumping part is formed with a stepped insertion hole and an oil well larger than this hole in diameter. The barrel has a fuel inlet port communicating with the oil well and an outlet port communicating with the oil path, and is finishing-processed in shape and size for coinciding with the stepped insertion hole. This barrel is inserted into the stepped hole while it is shrunken in size by cooling, and when returning to the room temperature, it recovers the shrinkage to an initial size and then it is closely united with the housing at the outer circumference and the end face.

Thereby, since the supporting area of the barrel is increased, and stress is dispersed, strength of the barrel is substantially improved. The barrel is not urged into the housing at the room temperature, but the former is inserted under condition that it is shrunken by cooling. Therefore, its strength is sufficient to be durable to force required to be inserted into the stepped hole. So, the barrel may be made thin in thickness, and the housing may be made small in diameter. In addition, the injection pumping part and the injection valve part are integrally united with the housing, and any connecting part of members does not exist, and the barrel is integral with the housing at high precision and so durable to the high pressure. The fuel does not run out from the contact therebetween, and pressure in a chamber can be fully heightened.

It is another object of the invention to provide a unit injector which may return the fuel effected with high pressure is exactly returned to low pressure without leaking outside for sending under pressure.

For accomplishing this object, the stepped insertion hole is formed with a plug hole having a female screw in an axial direction thereof, and a plug is inserted into the plug hole to form a high pressure sealing part as well as a slit communicating with the oil well in the housing, said plug having an edge contacting to the end of the barrel.

It is a further object of the invention to provide a unit injector which can exactly and automatically withdraw the air entering within the housing when the device is set up, or staying together with the fuel, so that exactness of performance test of the device can be assured after setting up, and improve starting capacity of an engine.

For accomplishing this object, the invention removes a dead zone of a fuel pressing chamber upper than the outlet port. A seat is formed at an opening of a plunge sliding hole formed in the barrel, and the plug is incorporated with a check valve seating on said seat. The the fuel is pressed, the check valve is opened by this pressure, and the fuel is sent under pressure to the oil path via the outlet port bent at the top of the barrel inner than the edge part.

DETAILED DESCRIPTION OF PREFERRED EMBODIMENTS OF THE INVENTION

Figure 1:
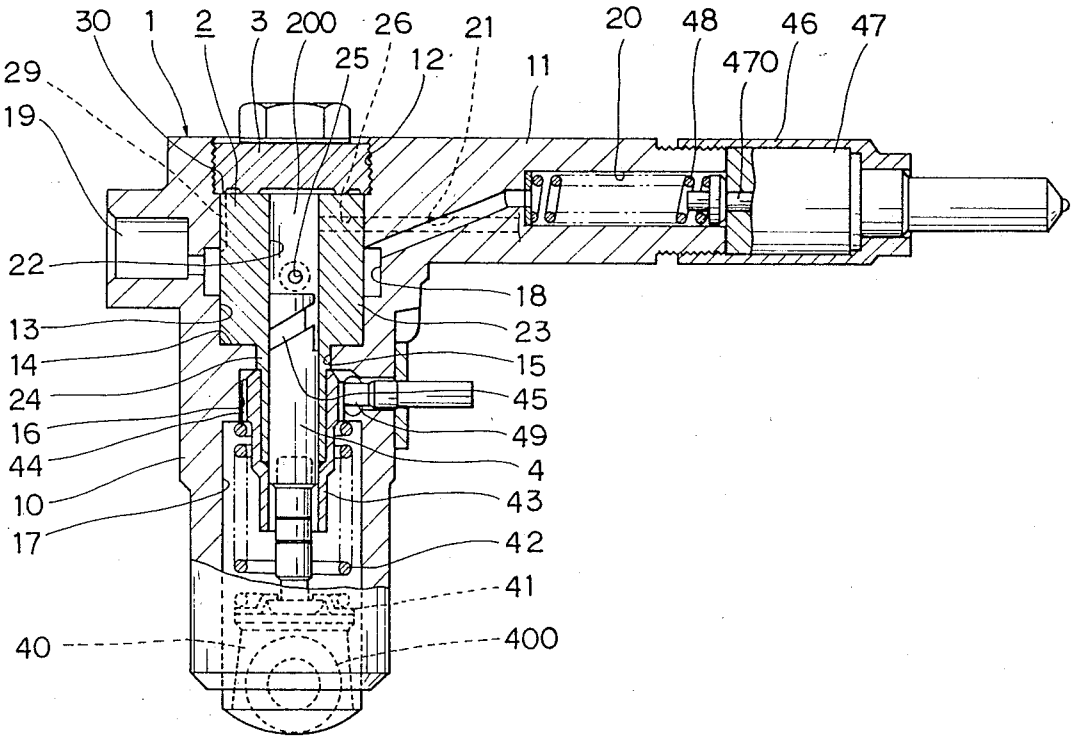
FIG. 1 is a cross sectional view showing an embodiment of the invention.
Figure 2:
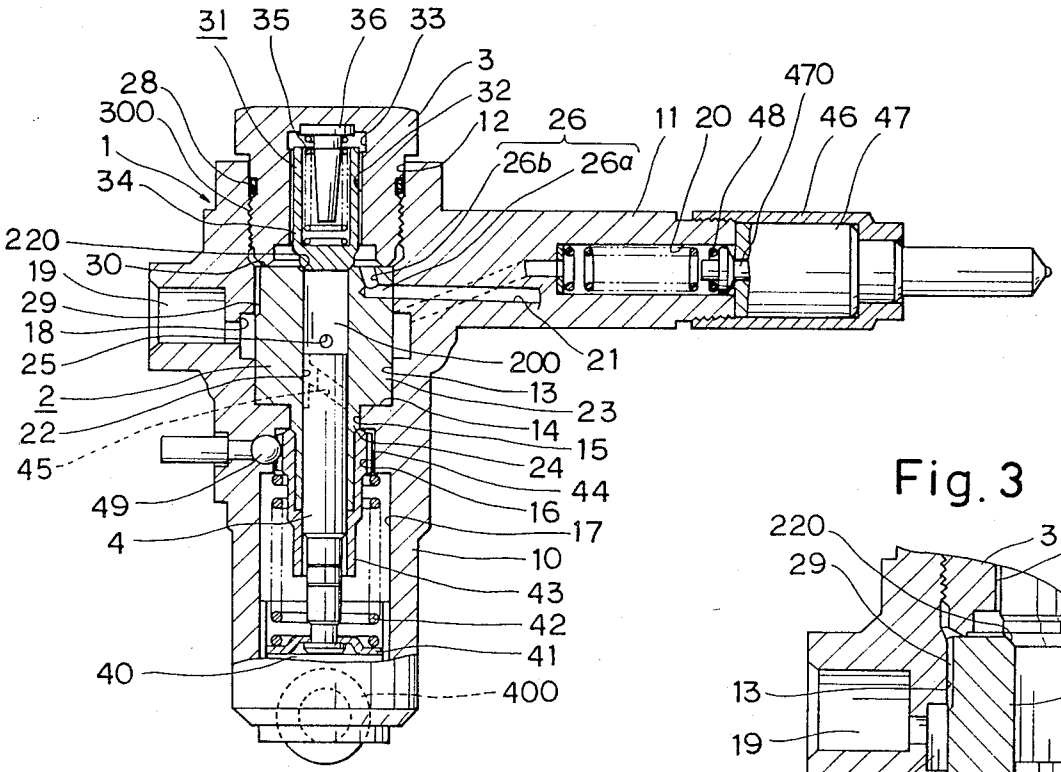
FIG. 2 is a cross sectional view showing another embodiment of the invention.
Figure 3:
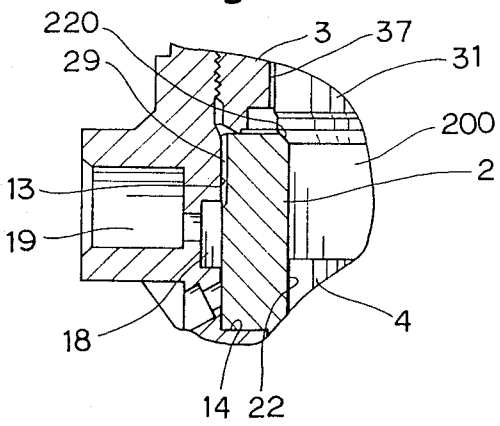
FIG. 3 is a view showing a partial enlargement of FIG. 2.
Figure 4:
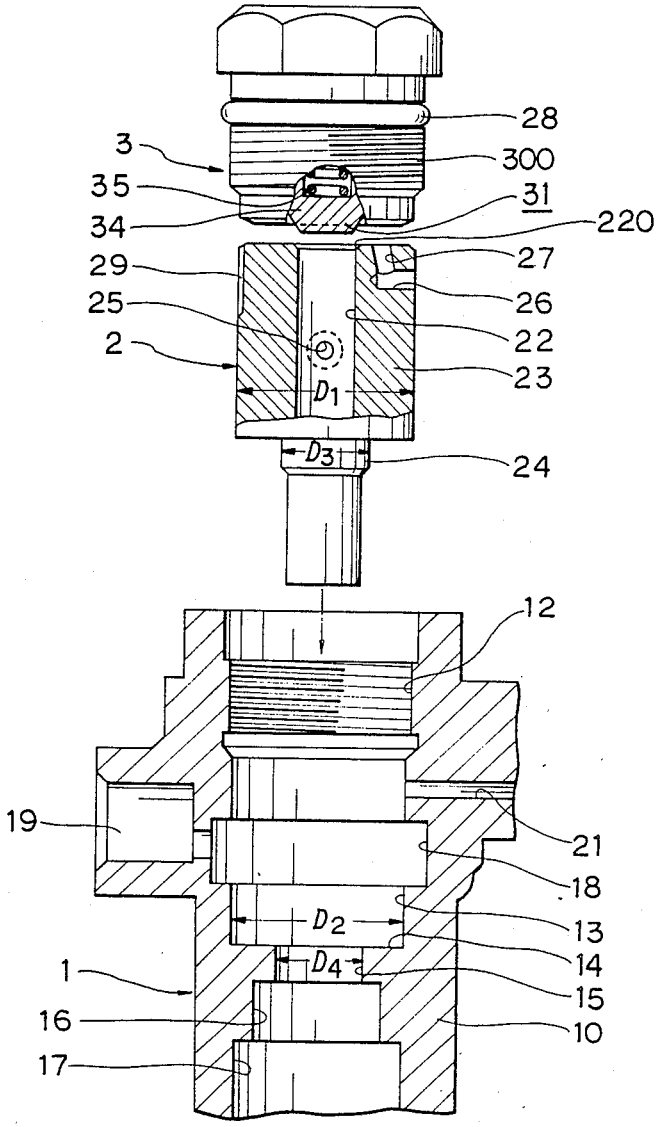
FIG. 4 is a disassembling view of FIG. 2 showing that a cooled barrel is going to get into a housing.

FIG. 1 shows one embodiment of a unit injector according to the invention, and FIGS. 2 to 4 show another embodiment.

In FIGS. 1 and 2, a reference numeral 1 designates a housing shaped in L, where a perpendicular injection pump part 10 and an injection valve part 11 are integrally formed, the latter extending in a direction transverse with an axial line of the pump part 10.

The injection pump part 10 is defined with a plug hole 12 having a female screw in a required length from its top. Continuing from the plug hole 12, a straight and cylindrical inserting hole 13 is formed concentrically which is reasonably smaller in size than the hole 12 and has a flat step portion (bottom) 14 at an end. Further, the hole 13 is the step 14 defined with a small diametered hole 15 centrally of the step portion 14, from which two-stepped holes 16, 17 are enlarged in diameter, the latter being opened toward the lower part of the pump part 10. The holes 16, 17 may be one stepped.

The inserting hole 13 is formed with a ring like oil well 18 concentrically at its middle in an axial direction thereof, one part of which communicates with an opening 19 absorbing a fuel at low pressure at a place slided, e.g., 180° in phase with respect to the injection valve valve 11.

The jetting valve part 11 is formed with a hole 20 for insering a nozzle spring in a required length from its end point, and a nozzle body 47 is coaxially secured by a cap nut 46 on the end point. A journal part 470 of a needle valve incorporated in the nozzle body 47 extends into the nozzle spring hole 20, and is biased to a seat by a nozzle spring 48 disposed in said hole 20. In the axial direction of the injection valve part 11, an oil path 21 is formed by sliding a phase as if making a detour around the hole 20 and goes to an oil well (not shown) of the nozzle body 47.

The reference numeral 2 designates a barrel which is made integral with the housing 1 by by fitting into the cylindrical inserting hole 13 under cooling. 3 is a plug screwed into the plug hole 12 after the barrel has been inserted under slight pressure into the hole 13, the plug being formed with a ring shaped edge portion 30 at its end part for contacting the top of the barrel 2. The barrel is shrunken in size by cooling, and under such a condition, it is inserted under pressure into the hole 3, and when the barrel is recovered to a room temperature, the size will become initial, so that the barrel is exactly fitted to the hole 13 without clearance.

The barrel 2 comprises a body part 23 shaped in circular column and a shaft part 24 extending therefrom downward. In a center passing through the body part 23 and the shaft part 24, a sliding hole 22 runs for guiding a plunger 4 from the top to a lower part. The body part 23 is finishing-processed in shape and outer diameter for coinciding with the hole 13 formed in the injection pumping part 10. Also, preferably the shaft part 24 is finishing-processed in an outer diameter of a part corresponding to the length of a small diametered hole 15, and the remainder becomes moderately narrow.

The barrel 2 is finishing-processed with an inlet port (low pressure port) 25 at a part corresponding to a lifting range of the plunger 4, communicating with the oil well 18, and is also finishing-processed with an outlet port (high pressure port) 26 communicating with an oil path 21 of the injection valve part 11.

The outlet port 26 is, in FIG. 1, provided crossing with the axial direction of the body part 23 and communicating with a pressure chamber 200 which is defined with the top of the plunger 4, the sliding hole 22 and the end of the plug 3. An outlet port 26 of an embodiment shown in FIG. 2 is formed with a lateral hole **26*a* extending from the outer diameter of the barrel 2 and stopping half way in thickness thereof and a longitudinal hole 26*b* opening toward an inside of the plug radius from the edge portion 30**.

The barrel 2 is treated with the finishing process and cooled in a step prior to being incorporated into the injection pumping part 10, whereby the entire body of the barrel 2 is shrunken uniformly. FIG. 4 shows representatively that a diameter D2 of the hole 13 agrees with an outer diameter D1 of the barrel body, and the shrinkage is made by cooling so as to provide $D1 > D2$. Also, an outer diameter D3 of shaft 24 and a diameter D4 of the small diametered hole 15 is shrunken so as to provide $D3 > D4$ by cooling. Such shrinkage could be accomplished by directly immersing the barrel into a fluid of low temperature as liquid nitrogen.

A shrinkage allowance is within a scope where the walls of the the cylindrical insertion hole 13 and the barrel 2 do not bite each other, but do not make a large clearance for easy centering.

The barrel 2 shrinked by cooling is effected with positioning with respect to a circumferential direction such that the outlet port 26 agrees with an oil hole 21 in the axial line, and under this condition the barrel 2 is passed into the plug hole 12, and is pushed down until the shaft 24 is fitted into the small diametered hole 15 and the end of the body 23 contacts a step 14 of the hole 13.

In the instant case, as the barrel is still shrunken in size, the inserting force may be weak. While the barrel 2 is left until the room temperature, it recovers to the size at the finishing process. By this recovery, the body 23 of the barrel 2 is exactly fitted into the hole 13 and to the step 14. Further in this embodiment, the shaft portion 24 is exactly fitted into the small diametered hole 15, and the both members are fixedly held.

The above mentioned is a fundamental structure of the present invention. In addition, following structures are adopted preferably.

One of them is to reduce pressure caused at a high pressure sealing part between the edge portion of the plug 3 and the top of the barrel 2. Actually, as seen in FIGS. 1 and 3, this is to form a slit 29 in the outer circumference of the body part 23 of the barrel 2, extending from the top to the oil well 18. Preferably, an o-ring 28 is provided at a range outside of a male screw 300 of the plug 3, and is closed to a straight wall of a plug hole 12.

The other is to incorporate a check valve 31 for withdrawing an air at the barrel 2 and the plug 3 facing a pressure chamber 200. As seen in FIG. 2, a blind hole 32 is formed, an innermost part of which is an expanded room 33 in the axial direction from the end portion of the plug 3, and into which a valve body 34 in cap shape is slidably inserted. On the other hand, the sliding hole 22 of the barrel 2 is formed at its opening with a seat face 220 for carrying a conical or tapered face of the valve body 34. The valve body 34 is disposed with a push spring 35 within its hollow space, the push spring 35 being supported by a volume controlling-stopper 36 held by the expanded chamber 33. The valve body 34 is formed circumferentially with a plurality of slits 37 for circulating high pressure as partially shown in FIG. 3.

In FIGS. 1 and 2, a numeral 40 designates a tappet for housing a roller 400 therein, which is provided in the hole 17 of the pumping part 10 and moves in axial direction by means of a cam of a cam shaft (not shown). 41 is a spring receipt contacting the tappet 40, and the plunger 4 is supported at its end on the spring receipt 41. 42 is a plunger spring biasing the plunger 4 to the tappet 40 between the spring receipt 41 and the bottom of the hole 17.

A numeral 43 is a sleeve for controlling the jetting amount, and this control sleeve 43 is as known mounted on the outer circumference of the shaft part 24 of the barrel 2 in relatively rotating relation, or allows only movement in the axial direction by a brim and a cutout with respect to the outer circumference of the plunger 4 but rotates integrally therewith in a circumferential direction. Further, it has a gear element 44 such as pinion on its outer circumference, and is in mesh with a rotation driving element 49 such as control rack inserted from the outside If it is given a rotation angle by the element 49, it rotates the plunger 4, thereby to change available stroke.

OPERATION

In the invention, the housing 1 is simple because it integrally comprises the injection pump part 10 and the injection valve part 11. The barrel 2 is not fixed by being forcibly pressed by the nozzle holder in the axial direction thereof as conventionally, but fixed by being fitted under slight pressure into the housing 1 while cooling it. That is, the barrel 2 is fixedly supported by the injection pump part 10 in a wide range over the hole 13, the step 14 and the small diametered hole 15, so that stress is dispersed. The barrel 2 is inserted into the housing 1 while it is shrunken, and is not urged into with respect to the same diameter. Therefore, it is possible that the barrel 2 has a thin thickness and small diameter. Since the barrel 2 is united with the housing 1 at high precision, they are well durable against the high pressure. The housing 1 is not composed with a plurality of connection or combinations of many members, so that it is resistable to the high pressure and no leakage of the fuel occurs.

According to the inventors' experiments, the housing including the injection pump part and the injection valve part was produced of mechanical structural carbon steel of S58C, and formed with a straight and cylindrical insertion hole of 20.0 mm in diameter and a small diametered hole of 10.0 mm in diameter. The barrel was finishing-processed of 20.0 mm in outer diamter of the body part and 10.0 mm in outer diameter of the shaft part from a block of a bearing steel. The inlet and outlet ports were finishing-processed in the structure as shown in FIG. 2, and before incorporating into the housing, they were cooled in the liquid nitrogen.

As a result, the barrel was shrunken and manually inserted by a tool into said insertion hole and the small diametered hole at the room temperature, and left until it recovered to the room temperature. Subsequently, the barrel was exactly united with the housing together with the body and the shaft part. When the fuel was pressed at high pressure as 1000kg/cm$^2$, no oil leakage was caused between the holes and the barrel.

The unit injector of the invention is provided to the cylinder block of the engine per each of the cylinders. The fuel is sent by a feed pump from the lower pressure fuel inlet 19 to the oil well 18 within the housing, and goes into the pressure chamber 200 from the inlet port 25 of the barrel. The tappet 40 is pushed up by a cam (not shown), so that the plunger 4 goes upward within the sliding hole 22, and when the inlet port 25 is closed, the fuel in the pressure chamber 200 is effected with high pressure, and the high pressure acts on the side of the nozzle via the outlet port 26 and the oil path 21. The pressure goes up to a determined level, the needle valve (not shown) of the nozzle body 47 is pushed up against the nozzle spring 48 and jets the fuel from the jetting hole into the cylinder. When the plunger 4 goes up and a lead 45 meets the inlet port 25 of the barrel 2, the pressed fuel escapes into the oil well 18, and the pressure of the chamber 200 rapidly drops. Then, since the needle valve is pressed by the nozzle spring 48, the fuel injection ceases. The fuel jetting amount is increased or decreased by rotation of the plunger 4 together with the control sleeve 43 via the gear element 44 by the rotation driving element 49.

The high pressure created by the lift of the plunger 4 is sealed by contacting of the edge 30 at the end of the plug 3 and the top of the barrel 2. If a part of the oil escaped outside by high pressure, the prior art was involved with a problem of flowing out the housing. However, if a slit 29 is formed in the side of the barrel 2 as seen in the embodiments of FIGS. 1 and 2, the pressed oil running out in the radius from the edge 30 of the plug 3 gathers in a space between the barrel 2 and the plug 3, and is sent to the oil well 18 through the slit 29 and mixed with the low pressure fuel oil. Since the barrel 2 is closely united with the hole 13 of the housing 1, the fuel does not flow in the circumferential direction, but exactly goes back to the oil well 18 in all the amount. Further if the o-ring 28 is provided to the plug 3 as seen in FIG. 2, then although the oil follows the male screw portion, the oil does not leak no more, and the oil leakage from the plug 3 is prevented more perfectly.

The unit injector was not provided with the air withdrawal mechanism in the prior art, and so if the air went into the interior when setting up the device, it stayed in a dead zone upper than the outlet port of the pressure chamber, and it was difficult to withdraw the air. However, in this point, when the check valve 31 is provided to the plug 3 as in FIG. 2, the fuel under high pressure pushes up the valve body 34 against the pressing spring 35 by the plunger 4. When the valve body 34 opens, a check valve chamber is formed inside in the radius of the edge part 30, into which the oil effected with high pressure goes from the pressure chamber 200, and the oil is sent under pressure from the oil path 21 to the nozzle via the hole 26*b* and the hole 26*a* of the barrel 2. Therefore, there does not appear a dead zone for the air in the pressure chamber 200. Therefore, if the air is mixed when setting up, it is automatically withdrawn, and the unit injector may be expected with respect to exactness of performance measuring data. In the following use, a starting capacity is increased when the engine is input, since the air is released.

What is claimed is:

1. In fuel injection means including a housing, an injection pumping mechanism in said housing and having a first axis, and an injection valve mechanism in said housing and having a second axis transverse to said first axis, said injection pumping mechanism including a barrel, a plunger and a control sleeve, said injection valve mechanism including an oil path and a nozzle body, the improvement comprising the following characteristics:

said housing having an axial cavity adapted to enclose said barrel, said axial cavity being shaped to define, in sequence, a plug hole, an insertion hole which is smaller in diameter than said plug hole and which has a circumferential recess and which terminates at a flat step, a small-diameter hole which is smaller in diameter than said insertion hole, and a bottom hole which is larger in diameter than said small-diameter hole;

said barrel including a body part having an axial sliding hole adapted slidably to receive said plunger, said sliding hole terminating in a value seat adapted to fit within said insertion hole so as to form, with said circumferential recess, an oil well and a shaft part adapted to slide within said small-diameter hole, said barrel having been cooled and then inserted into said axial cavity until said body part contacts said flat step and then permitted to expand to form an integral union with said housing;

said plug hole having a plug screwed therein, said plug having a ring shaped edge portion which contacts said barrel so as to form, with said plug hole, an annular space outside said edge portion, said barrel having a slit in its outer peripheral surface providing a passageway between said annular space and said oil well, said plug having an O ring adapted sealingly to engage said plug hole and having an air-withdrawing check valve having a valve body positioned on said seat so as to form, with said ring-shaped edge portion, an annular space inside said edge portion.

said barrel having an outlet port with a bent configuration providing communication between said oil path and said annular space within said ring-shaped edge portion.

2. Apparatus according to claim 1 wherein, in cooling said barrel and inserting said barrel into said axial cavity, said barrel is treated with a finishing process and cooled so as to shrink uniformly as by directly immersing said barrel into a fluid of low temperature such as liquid nitrogen and said shrunken barrel is circumferentially positioned such that said outlet port agrees with said oil path and under this condition said barrel is inserted into said axial cavity.

3. Apparatus according to claim 1 wherein said plug includes a blind hole, an innermost part of which is an expanded chamber spaced axially from the end portion of said plug, said valve body having a push spring, a hollow space enclosing said push spring and a volume controlling stopper held by said expanded chamber.

4. Apparatus according to claim 3 wherein said valve body is formed circumferentially with a plurality of slits for circulating high pressure.

* * * * *